US007057584B2

(12) United States Patent
Jeong

(10) Patent No.: US 7,057,584 B2
(45) Date of Patent: Jun. 6, 2006

(54) IMAGE DISPLAY METHOD AND SYSTEM FOR PLASMA DISPLAY PANEL

(75) Inventor: Jae-Seok Jeong, Ahsan (KR)

(73) Assignee: Samsung SDI Co., Ltd., Suwon (KR)

( * ) Notice: Subject to any disclaimer, the term of this patent is extended or adjusted under 35 U.S.C. 154(b) by 110 days.

(21) Appl. No.: 10/289,587

(22) Filed: Nov. 7, 2002

(65) Prior Publication Data

US 2003/0090444 A1 May 15, 2003

(30) Foreign Application Priority Data

Nov. 12, 2001 (KR) ..... 2001-70262

(51) Int. Cl.
*G09G 3/28* (2006.01)

(52) U.S. Cl. ..... 345/60; 345/63

(58) Field of Classification Search ..... 345/63, 345/37, 41, 60, 690, 691, 692
See application file for complete search history.

(56) References Cited

U.S. PATENT DOCUMENTS

| | | | | |
|---|---|---|---|---|
| 4,417,283 | A * | 11/1983 | Hoshimi et al. | 386/104 |
| 5,940,142 | A * | 8/1999 | Wakitani et al. | 348/671 |
| 6,552,701 | B1 * | 4/2003 | Tanaka | 345/63 |
| 6,714,250 | B1 * | 3/2004 | Correa et al. | 348/447 |
| 2002/0097201 | A1 | 7/2002 | Yamamoto et al. | |

FOREIGN PATENT DOCUMENTS

| | | |
|---|---|---|
| EP | 0 698 874 A1 | 2/1996 |
| EP | 0 774 745 A2 | 5/1997 |
| EP | 1 056 285 A2 | 11/2000 |
| JP | 2001-42818 | 2/2001 |
| KR | 2000-0016955 | 3/2000 |

OTHER PUBLICATIONS

Patent Abstracts of Japan for Publication No. 2001-042818; Date of publication of application Feb. 16, 2001.
European Search Report for Application No. 02090371.2, dated Dec. 17, 2004, in the name of Samsung SDI Co., Ltd.
Korean Patent Abstract,.Publication No. 1020000016955, Published Mar. 25, 2000, in the name of Deutsche Thomson-Brandt GmbH.
European Search report dated Nov. 24, 2005, for application No. 02090371.2, in the name of Samsung SDI Co., Ltd.
H. Kuriyama et al, "41.4: 50-Hz Flicker Reduction for PDP and Evaluation System Development", SID 01 Digest, Jun. 2001, pp. 1102-1105.

* cited by examiner

*Primary Examiner*—Amr A. Awad
*Assistant Examiner*—Leonid Shapiro
(74) *Attorney, Agent, or Firm*—Christie, Parker and Hale, LLP

(57) ABSTRACT

An image display method and system for a plasma display panel. An image of each field displayed on the plasma display panel corresponding to input image signals is divided into sub-fields. Weighting values of the sub-fields are combined to display grays. The sub-fields are divided into three continuous groups. Sub-fields corresponding to a Least Significant Bit (LSB) and a LSB+1 of each sub-field data are included in a second sub-field, which is positioned in a middle of the three consecutive groups with respect to time. Therefore, a time difference between the LSB and the LSB+1 of the sub-field data with respect to images displayed by 50 Hz Phase Alternating by Line (PAL) image signals is reduced such that contour noise between low gray regions is diminished.

14 Claims, 6 Drawing Sheets

| Sub-field | SF1 | SF2 | SF3 | SF4 | SF5 | SF6 | | SF1 | SF2 | | SF1 | SF2 | SF3 | SF4 | SF5 | SF6 | |
|---|---|---|---|---|---|---|---|---|---|---|---|---|---|---|---|---|---|
| Weight | 4 | 8 | 16 | 24 | 32 | 40 | Suspension interval | 1 | 2 | Suspension interval | 4 | 8 | 16 | 24 | 32 | 40 | Suspension interval |
| | G1 | | | | | | | G2 | | | G3 | | | | | | |

① → Suspension interval of G1, ② → Suspension interval of G2, ③ → Suspension interval of G3

| Sub-field | SF1 | SF2 | SF3 | SF4 | SF5 | SF6 | SF7 | | SF1 | SF2 | SF3 | SF4 | SF5 | SF6 | SF7 | |
|---|---|---|---|---|---|---|---|---|---|---|---|---|---|---|---|---|
| Weight | 1 | 4 | 8 | 16 | 24 | 32 | 40 | Suspension interval | 2 | 4 | 8 | 16 | 24 | 32 | 40 | Suspension interval |
| | G1 | | | | | | | | G2 | | | | | | | |

FIG.2 (Prior Art)

| Sub-field | SF1 | SF2 | SF3 | SF4 | SF5 | SF6 | SF7 | | SF1 | SF2 | SF3 | SF4 | SF5 | SF6 | SF7 | |
|---|---|---|---|---|---|---|---|---|---|---|---|---|---|---|---|---|
| Weight / Gray | 1 | 4 | 8 | 16 | 24 | 32 | 40 | Suspension interval | 2 | 4 | 8 | 16 | 24 | 32 | 40 | Suspension interval |
| 0 | | | | | | | | | | | | | | | | |
| 1 | ◎ | | | | | | | | | | | | | | | |
| 2 | | | | | | | | | ◎ | | | | | | | |
| 3 | ◎ | | | | | | | | ◎ | | | | | | | |
| 4 | | | | | | | | | | ◎ | | | | | | |
| 5 | ◎ | | | | | | | | | ◎ | | | | | | |
| 6 | | ◎ | | | | | | | ◎ | | | | | | | |
| 7 | ◎ | ◎ | | | | | | | ◎ | | | | | | | |
| 8 | | ◎ | | | | | | | | ◎ | | | | | | |
| 9 | ◎ | ◎ | | | | | | | | ◎ | | | | | | |
| 10 | | ◎ | | | | | | | ◎ | ◎ | | | | | | |
| 11 | ◎ | ◎ | | | | | | | ◎ | ◎ | | | | | | |
| | G1 | | | | | | | | G2 | | | | | | | |

FIG.4

| Sub-field | SF1 | SF2 | SF3 | SF4 | SF5 | SF6 | | SF1 | SF2 | | SF1 | SF2 | SF3 | SF4 | SF5 | SF6 | |
|---|---|---|---|---|---|---|---|---|---|---|---|---|---|---|---|---|---|
| Weight / Gray | 4 | 8 | 16 | 24 | 32 | 40 | Suspension interval | 1 | 2 | Suspension interval | 4 | 8 | 16 | 24 | 32 | 40 | Suspension interval |
| 0 | | | | | | | | | | | | | | | | | |
| 1 | | | | | | | | ◎ | | | | | | | | | |
| 2 | | | | | | | | | ◎ | | | | | | | | |
| 3 | | | | | | | | ◎ | ◎ | | | | | | | | |
| 4 | | | | | | | | | | | ◎ | | | | | | |
| 5 | | | | | | | | ◎ | | | ◎ | | | | | | |
| 6 | | | | | | | | | ◎ | | ◎ | | | | | | |
| 7 | | | | | | | | ◎ | ◎ | | ◎ | | | | | | |
| 8 | ◎ | | | | | | | | | | ◎ | | | | | | |
| 9 | ◎ | | | | | | | ◎ | | | ◎ | | | | | | |
| 10 | ◎ | | | | | | | | ◎ | | ◎ | | | | | | |
| 11 | ◎ | | | | | | | ◎ | ◎ | | ◎ | | | | | | |
| | G1 | | | | | | | G2 | | | G3 | | | | | | |

IMAGE DISPLAY METHOD AND SYSTEM FOR PLASMA DISPLAY PANEL

CROSS-REFERENCE TO RELATED APPLICATIONS

This application claims priority to and the benefit of Korean Application Number 2001-0070262, filed on Nov. 12, 2001 in the Korean Patent Office, the entire disclosure of which is incorporated herein by reference.

BACKGROUND OF THE INVENTION (a) Field of the Invention

The present invention relates to an image display method and system for a plasma display panel. More particularly, the present invention relates to an image display method and system for a plasma display panel that reduces flicker and contour noise generated in a low gray region when an image is realized by the input of 50 Hz Phase Alternating by Line (PAL) image signals.

(b) Description of the Related Art

A plasma display panel is a display device in which a plurality of discharge cells are arranged in a matrix, and the discharge cells are selectively illuminated to restore image data, which are input as electrical signals.

In such a plasma display panel, the display of gray must be possible in order to exhibit the capabilities of a color display device. A gray realization method is used to achieve this, in which a single field is divided into a plurality of sub-fields and the sub-fields are controlled by a process of time sharing.

A major concern for the designer of display devices is that of flicker. Flicker is closely related to how the human eye perceives images. Generally, flicker becomes more perceptible as screen size is made larger and frequency is lowered. In the case where images are realized in a plasma display panel using PAL image signals, both these factors are present such that a significant amount of flicker is generated.

Accordingly, if the plasma display panel is driven at a vertical frequency of 50 Hz using a minimum increase arrangement or a minimum decrease arrangement, which are sub-field arrangements typically used in plasma display panels, a significant amount of flicker is generated.

Among the two factors that make flicker more problematic, since it is not possible to change the screen size, flicker must be reduced by varying frequency. Korean Laid-open Patent No. 2000-16955 discloses a method of reducing flicker by adjusting frequency. In this disclosure, to reduce flicker in a plasma display panel having a large screen and operated by the input of 50 Hz image signals, sub-fields within a single field are divided into two groups (G1 and G2), and a weight arrangement of the sub-fields in each group is identical or all sub-field arrangements except an Least Significant Bit (LSB) sub-field have the same structure. Further, a feature of this disclosure is that a brightness weighting value in the two sub-field groups are identically distributed. The reduction of flicker with the use of this method is greatly improved over the conventional sub-field arrangement of a minimum increase arrangement or a minimum decrease arrangement.

FIG. 1 is a schematic view of a conventional sub-field arrangement, and FIG. 2 is a schematic view showing an example of realizing specific low grays using the conventional sub-field arrangement. As shown in the drawings, in the case where low grays, for example, low grays 0 to 11, are displayed using the conventional sub-field arrangement, a time difference of a few milliseconds occurs between sub-fields corresponding to a LSB and a LSB+1.

For example, in the case of the low gray 3, lowermost sub-field SF1 of group G1 is On and lowermost sub-field SF1 of group G2 is also On. In this case, the sub-field of group G1 becomes a LSB sub-field and the sub-field of group G2 becomes a LSB+1 sub-field, with a time difference between the sub-fields being a substantial 10 ms.

Low brightness illumination characteristics for a plasma display panel are non-linear. To compensate for the non-linear gray characteristics, an error diffusion method is used to display low brightness grays. However, with use of the conventional sub-field arrangement and application of error diffusion to display low grays, a time difference between the sub-fields corresponding to an LSB and an LSB+1 is as much as a few milliseconds. Since an illumination acceleration time of illumination having this time difference is short, it becomes perceptible to the human eye such that if there is movement in the image, severe contour noise develops at boundaries between grays.

SUMMARY OF THE INVENTION

In accordance with the present invention an image display method and system is provided for a plasma display panel that reduces flicker and contour noise by ensuring an adjacent configuration between sub-fields corresponding to an LSB and an LSB+1, which are often used in displaying low grays.

In accordance with the image display method for a plasma display panel an image of each field displayed on the plasma display panel corresponding to input image signals is divided into a plurality of sub-fields. Weighting values of the sub-fields are combined to display grays, wherein the plurality of sub-fields are divided into three continuous groups. The weighting values of the sub-fields in the group positioned second with respect to time are lower than a weighting value of a lowermost sub-field of the group positioned first with respect to time and lower than a weighting value of a lowermost sub-field of the group positioned third with respect to time.

A sub-field corresponding to a lower bit of sub-field data corresponding to gray is included in the group positioned second.

The lower bit of each sub-field data is a least significant bit or a least significant bit+1.

At least one of the groups is realized through sub-fields having weighting values that are different from the weighting values of the sub-fields included in the other one or two groups.

The group positioned first with respect to time and the group positioned third with respect to time have sub-fields of the same weighting values.

A last sub-field of the group positioned first is separated by a predetermined time from a first sub-field of the group positioned second, and a last sub-field of the group positioned second is separated by a predetermined time from a first sub-field of the group positioned third.

In accordance with the image display system for a plasma display panel an image of each field displayed on the plasma display panel corresponding to input image signals is divided into a plurality of sub-fields. Weighting values of the sub-fields are combined to display grays.

The system includes:

an image signal processor digitizing the image signals to generate digital image data;

a vertical frequency detector analyzing the digital image data output by the image signal processor to determine if the input image data are National Television Systems Committee (NTSC) signals or PAL signals, producing a data switch value indicating the result of this determination, and outputting the data switch value together with the digital image data;

a memory controller receiving the digital image data and the data switch value from the vertical frequency detector, generating sub-field data corresponding to whether the input image signals are one of the NTSC image signals and PAL image signals as indicated by the data switch value, and outputting the sub-field data to the plasma display panel, the sub-field data corresponding to sub-fields separated into three consecutive groups, and sub-fields corresponding to an LSB (Least Significant Bit) and an LSB+1 of each sub-field data being included in a second group, which is positioned in a middle of the three consecutive groups with respect to time; and a sustain/scan pulse driver controller receiving the digital image data and the data switch value from the vertical frequency detector, generating a sub-field arrangement structure depending on whether the input signals are one of the NTSC image signals and the PAL image signals as indicated by the data switch value, generating a control signal based on the generated sub-field arrangement structure, and outputting the control signal to the plasma display panel.

The memory controller includes:

an NTSC signal sub-field data generator generating NTSC signal sub-field data corresponding to the digital image data output by the vertical frequency detector, and outputting the NTSC signal sub-field data to the plasma display panel;

a PAL signal sub-field data generator generating PAL signal sub-field data corresponding to the digital image data output by the vertical frequency detector, and outputting the PAL signal sub-field data to the plasma display panel; and a data switch unit receiving the digital image data and the data switch value from the vertical frequency detector, and transmitting the digital image data to one of the NTSC signal sub-field data generator and the PAL signal sub-field data generator depending on the data switch value.

The PAL signal sub-field data generator includes:

a sub-field generator combining the three groups and generating sub-field data corresponding to grays of the digital image data;

a sub-field mapping unit mapping the sub-field data generated by the sub-field generator according to grays of the digital image data transmitted from the data switch unit; and a memory processor performing memory input/output processing of the sub-field data mapped by the sub-field mapping unit, and applying a result to the plasma display panel.

BRIEF DESCRIPTION OF THE DRAWINGS

FIG. 2 is a schematic view showing an example of realizing specific low grays using the conventional sub-field arrangement.

FIG. 4 is a schematic view showing an example of realizing specific low grays using the sub-field arrangement according to an embodiment of the present invention.

DETAILED DESCRIPTION OF THE INVENTION

Figure 1:
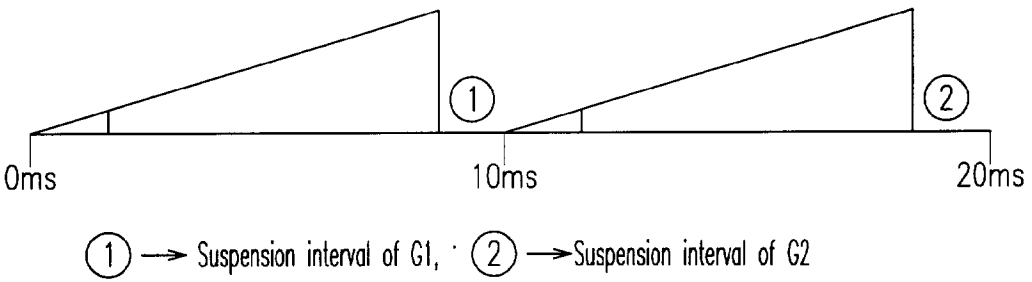
FIG.1 (Prior Art)
FIG. 1 is a schematic view of a conventional sub-field arrangement.
Figure 3:
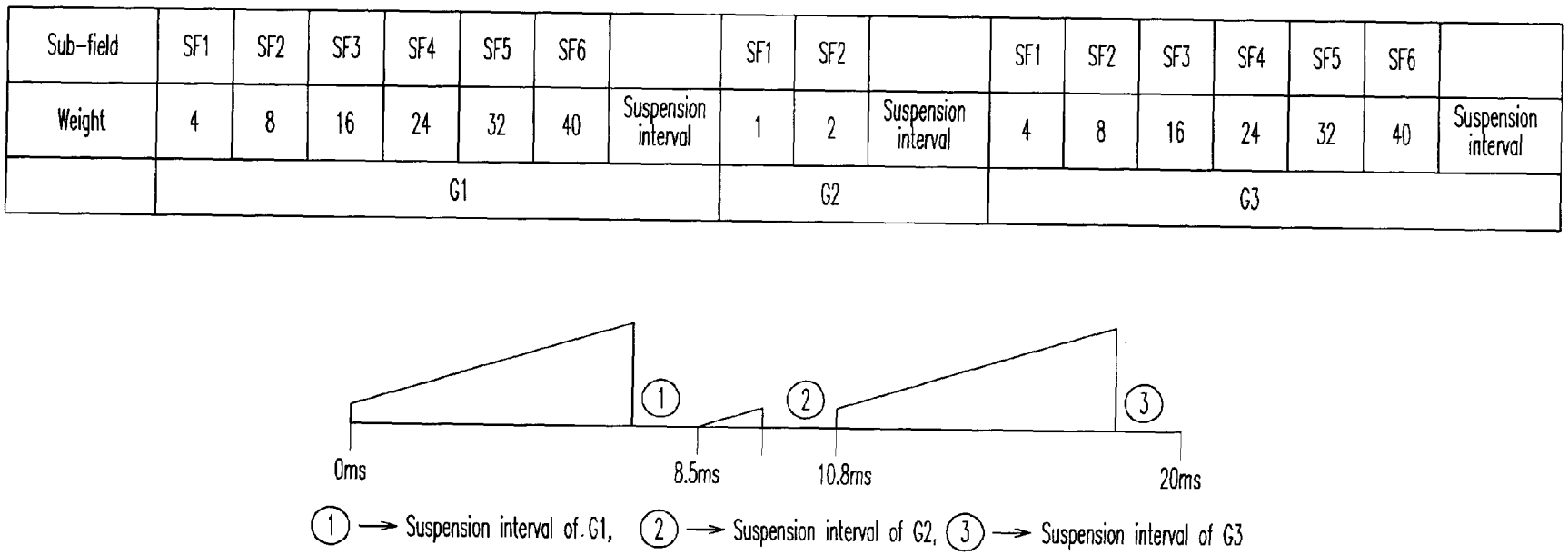
FIG. 3 is a schematic view of a sub-field arrangement according to an embodiment of the present invention.

With reference to FIG. 3, sub-fields according to an embodiment of the present invention are divided into three separate groups, that is, first, second, and third groups G1, G2, and G3. There are also three separate suspension intervals, which are vertical blanking intervals. That is, suspension interval (1) of first group G1 is positioned at a vertical section of first group G1, suspension interval (2) of second group G2 is positioned at a vertical section of second group G2, and suspension interval (3) of third group G3 is positioned at a vertical section of third group G3.

First group G1 and third group G3 have the same sub-field structure realized by six sub-fields. A weight of the six sub-fields becomes 4, 8, 16, 24, 32, and 40, starting from a lower sub-field. Second group G2 has two sub-fields having weights of 1 and 2, which are lower than the weights of the sub-fields of first group G1 and third group G3. That is, the sub-fields of second group G2 correspond to an LSB and an LSB+1. However, the present invention is not limited in this regard and it is possible for the sub-fields of second group G2 to be applied to higher lower bits.

First group G1 begins at a starting point of a first frame, that is, at 0 ms; second group G2 begins after 8.5 ms have elapsed after the starting point of the first frame; and third group G3 begins after 10.8 ms have elapsed after the starting point of the first frame.

With the arrangement of the sub-fields as described above, an illumination central axis of the sub-fields between a starting point of first group G1 and a starting point of third group G3, both of which have a large illumination weight, is identically maintained such that 100 Hz effects are obtained identically as in the prior art.

A time difference between the starting points of first and third groups G1 and G3 is approximately 0.8 ms greater than that of the prior art, resulting in the generation of flicker by a difference in the illumination central axis of the sub-fields. However, since an illumination frequency is within a specific vertical frequency region of between 50 and 100 Hz, the human eye does not easily perceive the flicker because of the high frequency (it is difficult to perceive flicker with a vertical frequency of 60 Hz or higher). Therefore, flicker reduction characteristics may be obtained identically as in the prior art.

Unlike the prior art, the sub-fields corresponding to the LSB and LSB+1 that display low grays are contained in second group G2, and second group G2 is positioned between first and third groups G1 and G3 such that the time difference between sub-fields may be reduced in the case of low grays. As a result, contour noise is significantly reduced at boundaries between grays when there is movement in an image displaying low grays.

FIG. 4 is a schematic view showing an example of realizing specific low grays using the sub-field arrangement according to an embodiment of the present invention.

As shown in FIG. 4, in the case where low grays, for example, low grays of 0 to 11, are displayed using the sub-field arrangement of an embodiment of the present invention, the time difference between sub-fields corresponding to the LSB and LSB+1 is considerably reduced compared to when the prior art sub-field arrangement is used. Therefore, contour noise in the boundaries between grays is reduced substantially even when there is movement in a gray image displayed by error diffusion.

For example, in the case of low gray 3, since this may be displayed only by second group G2 in an embodiment of the present invention, the resulting time difference is extremely small. When compared to the prior art sub-field arrangement shown in FIG. 2 where the time difference is on the order of a few milliseconds, a considerable reduction is realized.

As another example, in the case of low gray 7, display is realized by second group G2 and third group G3, and in this case corresponds to the lower sub-fields of third group G3 such that the time difference is very small. On the other hand, when displaying low gray 7 using the prior art sub-field arrangement shown in FIG. 2, since the time difference is again a few milliseconds, a substantial reduction is realized with the present invention over the prior art.

Therefore, in an embodiment of the present invention, by ensuring an adjacent configuration of the sub-fields corresponding to the LSB and LSB+1, which are often used in displaying low grays, the display of low grays by error diffusion is improved over the prior art.

Figure 5:
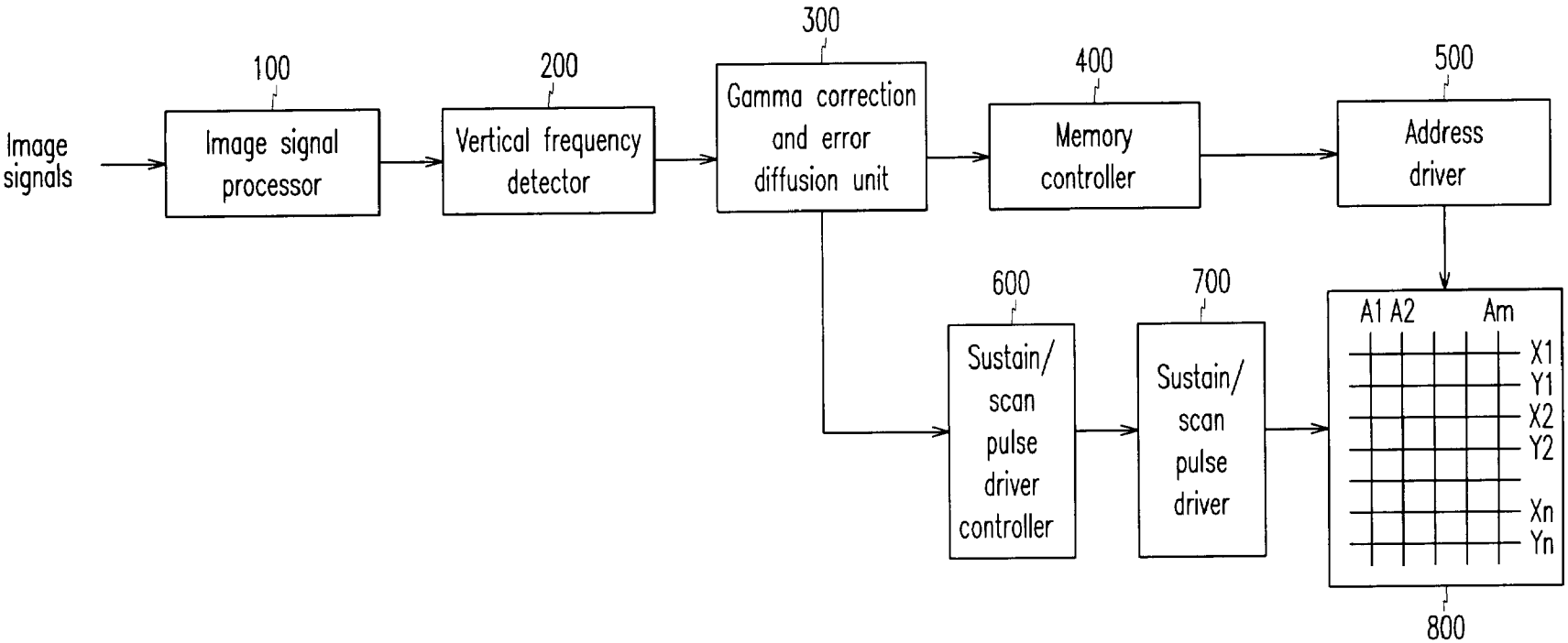
FIG. 5 is a block diagram of an image display system for a plasma display panel according to an embodiment of the present invention.

FIG. 5 is a block diagram of an image display system for a plasma display panel according to an embodiment of the present invention.

As shown in the drawing, the image display system for a plasma display panel according to an embodiment of the present invention includes image signal processor 100, vertical frequency detector 200, gamma correction and error diffusion unit 300, memory controller 400, address driver 500, sustain/scan pulse driver controller 600, and sustain/scan pulse driver 700. Reference numeral 800 indicates a plasma display panel. Image signal processor 100 digitizes image signals, which are received externally, to generate RGB data, after which image signal processor 100 outputs the RGB data.

Vertical frequency detector 200 analyzes the RGB data output by image signal processor 100 to determine if the input image signals are 60 Hz NTSC signals or 50 Hz PAL signals. Vertical frequency detector 200 then produces a data switch value indicating the result of this determination, and outputs the data switch value together with the RGB data.

Gamma correction and error diffusion unit 300 receives the RGB data that is output from vertical frequency detector 200 to perform correction of gamma values to correspond to the characteristics of plasma display panel 800, and, simultaneously, to perform diffusion processing of display errors with respect to peripheral pixels. Gamma correction and error diffusion unit 300 then outputs a result of these processes, and also outputs the data switch value, which indicates whether the input image signals are 50 Hz or 60 Hz image signals, without changing or converting the data switch value to memory controller 400.

Memory controller 400 receives the RGB data and the data switch value output by gamma correction and error diffusion unit 300, then generates sub-field data corresponding to the RGB data according to whether the input image signals are 50 Hz or 60 Hz image signals, as indicated by the data switch value. In the case where the data switch value indicates the input image signals are 60 Hz signals, sub-field data is generated corresponding to the RGB data using the conventional method, in which a single sub-field group is used to generate sub-field data.

However, if the data switch value indicates the input image signals are 50 Hz signals, rather than generating sub-field data by the conventional method of separation into two sub-field groups, the sub-fields are separated into three groups G1, G2, and G3 as shown in FIG. 3, and sub-field data is generated as described with reference to FIG. 3. That is, sub-field data is generated corresponding to the RGB data such that the LSB and LSB+1 data of the sub-field data is positioned in second group G2. The sub-field data generated in this manner undergoes memory input/output processing and is output to address driver 500.

Address driver 500 generates address data corresponding to the sub-field data output by memory controller 400. Address driver 500 then applies the address data to address electrodes (A1, A2, . . . Am) of plasma display panel 800.

Sustain/scan pulse driver controller 600 receives the RGB data and the data switch value from gamma correction and error diffusion unit 300, and generates a sub-field arrangement structure depending on whether the input signals are 50 Hz or 60 Hz input signals, as indicated by the data switch value. Sustain/scan pulse driver controller 600 also generates a control signal based on the generated sub-field arrangement structure, then outputs the control signal to sustain/scan pulse driver 700.

Sustain/scan pulse driver 700 generates a sustain pulse and a scan pulse according to the control signal output by sustain/scan pulse driver controller 600, then applies the sustain pulse and the scan pulse respectively to sustain electrodes (Y1, Y2, . . . Yn) and scan electrodes (X1, X2, . . . Xn) of plasma display panel 800.

Figure 6:
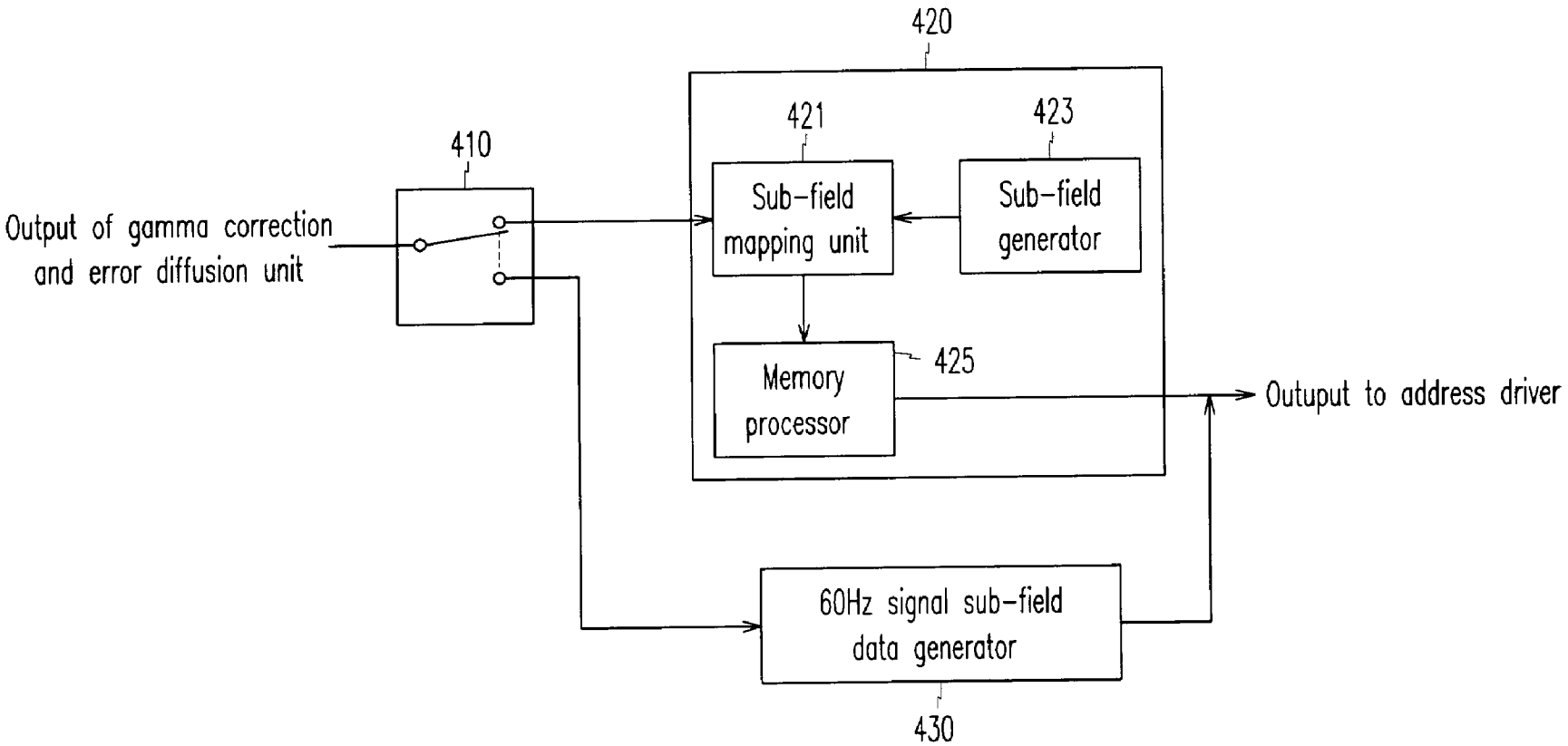
FIG. 6 is a detailed block diagram of a memory controller in the image display system of FIG. 5.

FIG. 6 is a detailed block diagram of memory controller 400 in the image display system of FIG. 5.

As shown in FIG. 6, memory controller 400 includes data switch 410, 50 Hz signal sub-field data generator 420, and 60 Hz signal sub-field data generator 430. Data switch 410 receives the RGB data and the data switch value output by gamma correction and error diffusion unit 300, and transmits the RGB data to either 50 Hz signal sub-field data generator 420 or 60 Hz signal sub-field data generator 430 depending on the data switch value. That is, if the data switch value indicates that the input image signals are 50 Hz image signals, data switch 410 transmits the RGB data to 50 Hz signal sub-field data generator 420, while if the data switch value indicates that the input image signals are 60 Hz image signals, data switch 410 transmits the RGB data to 60 Hz signal sub-field data generator 430.

60 Hz signal sub-field data generator 430 generates sub-fields using a single sub-field group as in the prior art. Since such a method is well known to those skilled in the art, a detailed description thereof will not be provided.

50 Hz signal sub-field data generator 420 includes sub-field mapping unit 421, sub-field generator 423, and memory processor 425. Sub-field generator 423 performs control to allow the display of grays by combining the three groups G1, G2, and G3 according to an embodiment of the present invention. Sub-field mapping unit 421 performs mapping of suitable sub-field data generated in sub-field generator 423 according to grays of the RGB data transmitted from data switch 410. Memory processor 425 performs memory input/output processing of the sub-field data mapped by sub-field mapping unit 421.

In the above, memory controller 400 and sustain/scan pulse driver controller 600 perform their operations according to the data switch value generated by vertical frequency detector 200 that indicates whether the input image signals are 50 Hz or 60 Hz signals. However, the present invention is not limited in this respect and this distinction depending on whether the image signals are 50 Hz or 60 Hz signals as indicated by the data switch value may be made in gamma correction and error diffusion unit 300.

In accordance with the present invention described above, the time difference between the LSB and LSB+1 of sub-field data with respect to images displayed using 50 Hz PAL image signals is reduced. As a result, contour noise generated in a low gray region is significantly minimized.

Although specific embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An image display method for a plasma display panel wherein an image of each field displayed on the plasma display panel corresponding to input image signals is divided into a plurality of sub-fields and weighting values of the sub-fields are combined to display grays, the method comprising:

dividing the plurality of sub-fields into a first group, a second group and a third group with respect to time, the first group being positioned before the second group, the second group being positioned before the third group and being a pair of sub-fields; and providing weighting values of one of the pair of the sub-fields in the second group lower than a weighting value of a lowermost sub-field of the first group and an other of the pair of the sub-fields in the second group lower than a weighting value of a lowermost sub-field of the third group, wherein the first group is separated from the second group by a first suspension interval and the second group is separated from the third group by a second suspension interval.

2. The method of claim 1, further comprising including in the second group a sub-field corresponding to a lower bit of sub-field data corresponding to gray.

3. The method of claim 2, wherein the lower bit of sub-field data comprises a least significant bit.

4. The method of claim 3, wherein the lower bit of sub-field data further comprises a least significant bit +1.

5. The method of claim 1, wherein at least one of the groups is realized through sub-fields having weighting values that are different from the weighting values of the sub-fields included in the other two groups.

6. The method of claim 1, wherein the first group and the third group have sub-fields of the same weighting values.

7. The method of claim 1, further comprising separating a last sub-field of the first group by a predetermined time from a first sub-field of the second group, and separating a last sub-field of the second group by a predetermined time from a first sub-field of the third group.

8. The method of claim 1, further comprising starting the first sub-field of the third group 10 to 12 ms after the start of the frame interval if the input image signals are 50 Hz image signals which have a frame interval of 20 ms.

9. The method of claim 8, further comprising starting the first sub-field of the second group 8 to 9 ms after the start of the frame interval.

10. The method of claim 9, wherein a weight of the first group and the third group is 4, 8, 16, 24, 32, and 40 starting from a lowermost sub-field; and a weight of the second group is 1 and 2 starting from a lowermost sub-field.

11. An image display system for a plasma display panel wherein an image of each field displayed on the plasma display panel corresponding to input image signals is divided into a plurality of sub-fields and wherein weighting values of the sub-fields are combined to display grays, the system comprising:

an image signal processor digitizing the input image signals to generate digital image data;

a vertical frequency detector analyzing the digital image data output by the image signal processor to determine if the input image data are NTSC signals or PAL signals, producing a data switch value indicating the result of this determination, and outputting the data switch value together with the digital image data;

a memory controller receiving the digital image data and the data switch value from the vertical frequency detector, generating sub-field data corresponding to the NTSC image signals or the PAL image according to the data switch value, and outputting the sub-field data to the plasma display panel, the sub-field data corresponding to sub-fields separated into three consecutive groups separated by suspension intervals, and sub-fields corresponding to an LSB (Least Significant Bit) and an LSB+1 of each sub-field data being included in a second group as a pair, the pair being positioned in a middle of the three consecutive groups with respect to time; and a sustain/scan pulse driver controller receiving the digital image data and the data switch value from the vertical frequency detector, generating a sub-field arrangement structure depending on whether the input signals are one of the NTSC image signals and the PAL image signals according to the data switch value, generating a control signal based on the generated sub-field arrangement structure, and outputting the control signal to the plasma display panel.

12. The image display system of claim 11, wherein the memory controller includes:

an NTSC signal sub-field data generator generating NTSC signal sub-field data corresponding to the digital image data output by the vertical frequency detector, and outputting the NTSC signal sub-field data to the plasma display panel;

a PAL signal sub-field data generator generating PAL signal sub-field data corresponding to the digital image data output by the vertical frequency detector, and outputting the PAL signal sub-field data to the plasma display panel; and a data switch unit receiving the digital image data and the data switch value from the vertical frequency detector, and transmitting the digital image data to one of the NTSC signal sub-field data generator and the PAL signal sub-field data generator depending on the data switch value.

13. The image display system of claim 12, wherein the PAL signal sub-field data generator includes:

a sub-field generator combining the three groups and generating sub-field data corresponding to grays of the digital image data;

a sub-field mapping unit mapping the sub-field data generated by the sub-field generator according to grays of the digital image data transmitted from the data switch unit; and a memory processor performing memory input/output processing of the sub-field data mapped by the sub-field mapping unit, and applying a result to the plasma display panel.

14. The image display system of claim 11, wherein a suspension interval is positioned between the second group and a third group of the three consecutive groups, the third group being positioned after the second group.

* * * * *